US005217138A

United States Patent [19]

Nichols

[11] Patent Number: 5,217,138

[45] Date of Patent: Jun. 8, 1993

[54] LIQUID TRANSPORT DRUM WITH REMOVABLE LINER

[75] Inventor: Dwight E. Nichols, Beatrice, Nebr.

[73] Assignee: Hoover Group, Inc., Alpharetta, Ga.

[21] Appl. No.: 881,328

[22] Filed: May 7, 1992

Related U.S. Application Data

[63] Continuation of Ser. No. 661,337, Feb. 25, 1991, abandoned.

[51] Int. Cl.[5] ..... B65D 25/16

[52] U.S. Cl. ..... 220/403; 220/465

[58] Field of Search ..... 220/403, 404, 465, 723, 220/254, 367, 466, DIG. 19, DIG. 29, DIG. 27

[56] References Cited

U.S. PATENT DOCUMENTS

| | | | |
|---|---|---|---|
| 3,159,306 | 12/1964 | Lyall | 220/404 |
| 3,321,103 | 5/1967 | Phillips | 220/404 |
| 3,432,070 | 3/1969 | Carpenter, Jr. et al. | 220/466 |
| 3,756,367 | 9/1973 | Mitchell et al. | 220/723 |
| 3,765,574 | 10/1973 | Urquiza | 220/404 |
| 3,918,605 | 11/1975 | Butler | 220/404 |
| 4,151,929 | 5/1979 | Sapien | 220/404 |
| 4,327,842 | 5/1982 | Walter | 220/367 |

FOREIGN PATENT DOCUMENTS

| | | | |
|---|---|---|---|
| 2594415 | 8/1987 | France | 220/466 |

*Primary Examiner*—Allan N. Shoap
*Assistant Examiner*—S. Castellano
*Attorney, Agent, or Firm*—Harness, Dickey & Pierce

[57] ABSTRACT

A container for retaining bulk liquid materials is provided having an outer drum forming an enclosed cavity bounded by a base portion, upright walls and a top wall including at least one port. A liner is disposed within the cavity of the outer drum and is fixably secured to a first bung removably engaged with the port. The first bung has a central opening enabling access to the interior of the liner for filling and discharge purposes. When filled with a bulk liquid material, the liner conforms in shape to the shape of the enclosed cavity of the drum. The first bung opening is sealed by a second bung member in engagement with the first bung member. Upon the emptying of the bulk materials from the drum, the liner, being thin walled, substantially fully collapses. The first bung member may then be disengaged from the port and the liner, in its collapsed state, removed through the port in the top wall of the drum. Thus, an easily removable liner is provided which eliminates the necessity of cleaning the drum prior to subsequent use.

2 Claims, 2 Drawing Sheets

LIQUID TRANSPORT DRUM WITH REMOVABLE LINER

This is a continuation of U.S. patent application Ser. No. 661,337 filed Feb. 25, 1991, now abandoned.

BACKGROUND AND SUMMARY OF THE INVENTION

The present invention is a container for the transportation of bulk liquid materials. More particularly, the present invention is a 55 gallon drum having an inner, disposable liner which is heat sealed at an aperture in its upper end to a bung which in turn may be secured to a fill opening in the top wall of the drum. When filled with a bulk liquid material, the liner conforms in shape to the shape of the inner surfaces of the tank and, upon being emptied, the liner collapses and is easily removed from the drum through the fill opening.

The most desirable and convenient method of transporting various liquid materials is in bulk quantities. While numerous containers may be used for such transportation, the 55 gallon drum has gained widespread acceptance by commercial suppliers and industrial consumers. A variety of materials, including such substances as solvents and grease, are transported in these 55 gallon drums. Regardless of the material being transported, if the drum is to be subsequently used for transporting a differing substance, the inside of the drum must be cleaned prior to the subsequent use.

U.S. Pat. No. 4,044,912, issued Aug. 30, 1977, assigned to the Assignee of the present application, discloses a container including a rigid outer tank having a collapsible bag liner for retaining viscous substances such as grease. A vane shaped spacer is disposed within the bag to provide a skeletal structure about which the bag can collapse as the viscous substances are removed. The skeletal structure thereby ensures a more complete evacuation of the viscous material contained in the tank.

It is an object of the present invention to provide a drum which may be used to transport a bulk liquid material without having to be cleaned prior to such use.

It is also an object of the present invention to provide a drum having a disposable liner for the transportation of bulk liquid materials.

It is another object of the present invention to provide a drum having a liner which is secured to a bung which is in turn mounted in an opening formed in the top wall of the drum.

It is an additional object of the the present invention to provide a drum which allows for easy removal of the liner through an opening formed in the top wall of the drum.

The present invention provides for a 55 gallon drum which may be formed of a plastic or metal and has two openings formed in its top wall. A plastic liner is disposed within the drum and has formed therein two apertures which are substantially aligned with the openings. At one aperture, a portion of the liner extending therearound is heat sealed to an outer bung which is then threaded into the appropriate opening. The body of the outer bung extends through the opening and has a threaded central opening which provides access to the interior of the liner. As the liner is filled with the materials to be transported, it conforms in shape to the shape of the inside surface of the drum. An inner bung is then positioned in the threaded opening of the outer bung to seal the drum. As the container is emptied, the liner collapses and is readily removed from the drum through one of the openings formed in the top wall.

Thus, the present invention facilitates the removal of the transported materials, the disposal of residue after discharge and the elimination of cleaning prior to reuse. In that the liner may be disposed of through burial, incineration or recycling, no large quantities of water are needed for cleaning purposes.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE DRAWINGS

Figure 1:
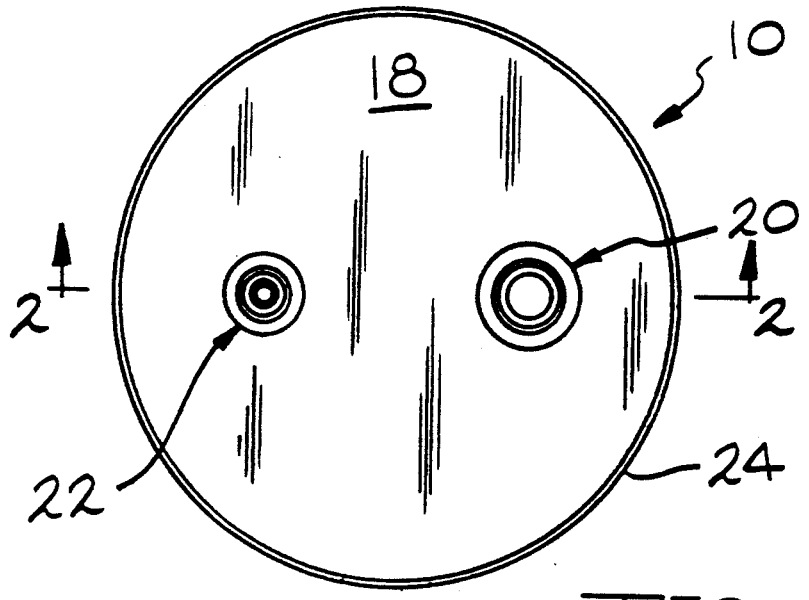
FIG. 1 is a plan view of a bulk liquid material transportation container incorporating the principles of the present invention.

Now with reference to the drawing, FIG. 1 illustrates a plan view of a container 10 embodying the principles of the present invention. An outer drum 12, in the shape of a standard 55 gallon drum, is formed of metal, plastic or other material and includes a base 14, upright side walls 16 and a top wall 18 which combine to define a central cavity 19. Formed in the top wall 18 and rising thereabove are two ports or openings 20 and 22. In the event of an object falling on top of the container 10 or the container 10 being toppled onto its side, the top wall is further provided with a rim 24 designed to prevent damage to the openings 20 and 22.

Disposed within the central cavity 19 of the drum 12 is a liner 26. The liner 26 is constructed of a thin plastic material having a thickness approximately three times that of a common household garbage bag. Two apertures 28 and 30 are formed in the top of the liner 26 and are substantially aligned with the openings 20 and 22 of the drum 12.

While the container 10 is illustrated as having two openings 20 and 22, the present invention could also be constructed with a single opening. However, a 55 gallon drum provided with two openings is standard within the industry and permits all of the normal operations required of the drum 12. The larger 20 of the two openings 20 and 22 is generally used for filling and emptying the container 10 while the smaller of the openings 22 is typically used as a vent opening.

When the liner 26 of the present invention is to be incorporated into a drum 12 having two openings 20 and 22, a portion 27 of the liner 26 defining one of the two apertures 28 and 30 is fixably secured to an outer bung 32. The outer bung 32 may be formed of rigid plastic or similar material. In that the outer bung 32 is also formed of plastic, this securement can be achieved by heat sealing or welding the liner 26 to the outer bung 32 to insure a securement in which the liner is non-removable from the bung 32.

Figure 2:
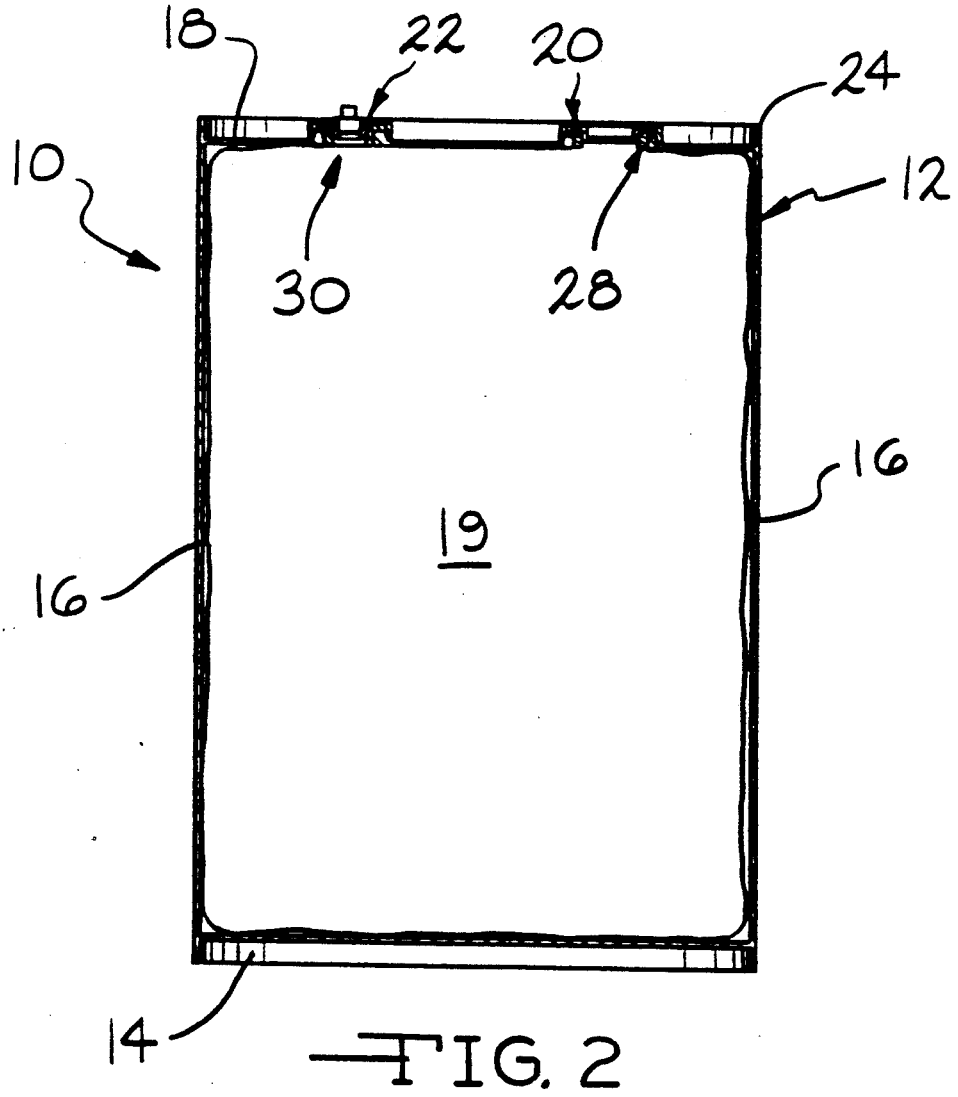
FIG. 2 is a sectional view taken substantially along line 2—2 in FIG. 1 illustrating the position of the liner within the drum when filled with a bulk liquid material.

Two embodiments of a bung structure constructed in accordance with the principles of the present invention are disclosed. While both embodiments are simultaneously shown in FIG. 2, only one of the openings 20 or 22 will incorporate an embodiment at a given time. The present invention may be incorporated into either of the two openings 20 or 22, however, for the sake of clarity, only one opening 20 will be discussed in the following description. Where appropriate, corresponding features of the embodiments will be given like designations in FIGS. 3 and 4.

Figure 3:
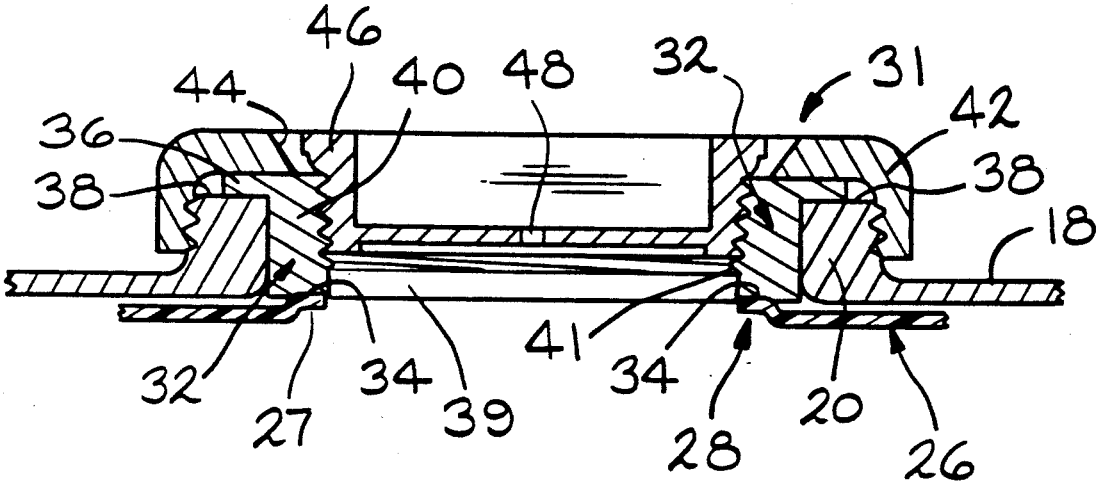
FIG. 3 is an enlarged sectional view of a portion of FIG. 2 detailing one embodiment the liner and bung construction of the present invention.

As seen in FIG. 3, in the bung structure 31 of the first embodiment, the portion 27 of the liner 26 forming the larger aperture 28 is heat sealed to a lower portion 34 of the outer bung 32. The outer bung 32 includes a cylindrical body 40 which extends downward through the opening 20 thereby constricting the opening 20. However, outer bung 32 does not fully constrict the opening 20 in that a threaded portion 41 of the cylindrical body 40 defines an access opening 39 to the interior of the liner 26. Integrally formed with the cylindrical body 40 is an outwardly extending flange 36 which engages an upper portion 38 of the opening 20. The resting engagement of the flange 36 with the upper surface 38 of the opening 20 thus supports and prevents the outer bung 32 and attached liner 26 from passing through the opening 20 and into the cavity 19 of the drum 12.

The liner 26 is installed in the drum 12 by inserting it through the opening 20. When the liner 26 is fully inserted, the flange 36 of the outer bung 32 will engage the upper surface 38 of the opening 20 and support the liner 26 hanging therebelow in the central cavity 19. To align the second aperture 30 with the remaining opening 22, the liner 26, along with the outer bung 32, is rotated. The second aperture 30 may be secured to the drum 12 by various methods. One possible method is to draw the portion defining the aperture 30 up through the second opening 22 and securing it therearound by means of a threaded engagement with a cap or conventional bung.

For safe operation of the drum 12, the outer bung 32 of the first embodiment is secured to the opening 20 formed in the top wall 18. In so doing, the present embodiment provides an interiorly threaded closure cap 42 which engages the exterior threads of the opening 20. Upon full engagement, the flange 36 of the outer bung 32 is securely retained between the upper surface 38 of the opening 20 and the cap 42.

The closure cap 42 is also provided with an central opening 44. The opening 44 permits the contents of the container 10 to be accessed while the outer bung 32 is retained securely in position. To seal the opening 20 for transportation of the drum 12, an inner bung 46 is provided which engages the threaded portion 41 of the cylindrical body 40.

As described above, when two openings 20 and 22 are incorporated into the top wall 18, filling of the container 10 is easily achieved by providing two points from which the liner 26 may hang. The side walls 16 or top wall 18 of the drum 12 may be further provided with vent openings (not shown) to allow air contained between the drum 12 and the liner 26 to evacuate during filling and expansion of the liner 26. To further assist in the filing of the liner 26, the cap securing the second aperture 30 in position may be provided with a vent opening which permits the evacuation of air from the liner 26 itself.

As previously mentioned, the container 10 can be constructed without a second opening 22. When constructed in this manner, the liner 26 may be provided with a tab (not shown) designed to fit into a corresponding tab opening (not shown) and thereby secure the liner 26 during filling of the container 10.

When being transported, both bung openings 20 and 22 of the container 10 may be completely sealed or provided with a vent opening 48. One such vent opening 48 is illustrated on the inner bung 46 of FIG. 3 and another is further described below in the description of the second embodiment.

Figure 4:
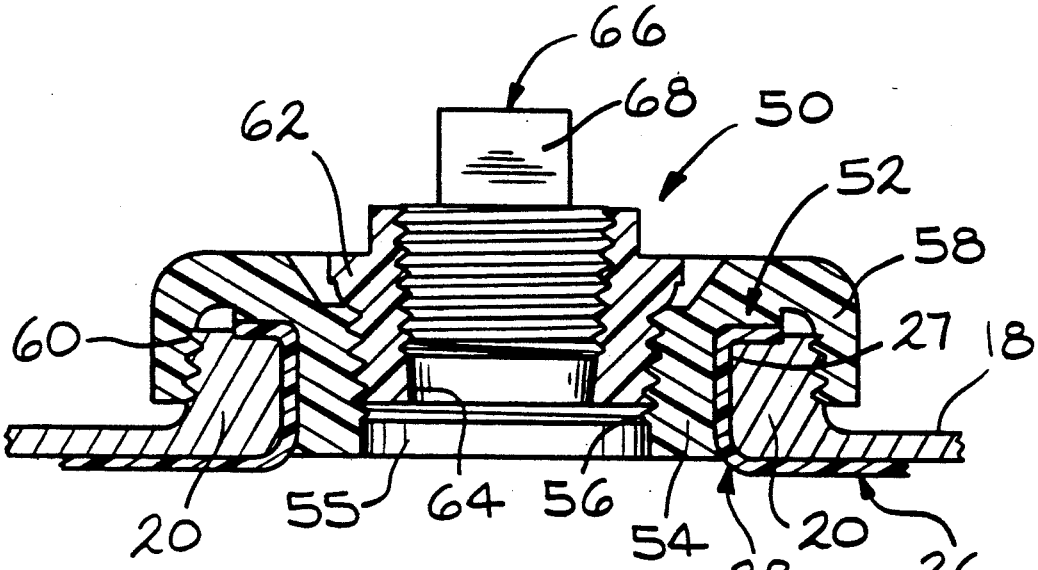
FIG. 4 is an enlarged sectional view of a portion of FIG. 2 illustrating a second embodiment of the liner and bung construction of the present invention.

The embodiment shown in FIG. 4 illustrates a bung structure 50 where the cap, flange and cylindrical body are integrally formed to produce an outer bung or bulkhead 52. In the second embodiment, the portion 27 of the liner 26 forming the aperture 28 is heat sealed to the outer surface of an inner cylindrical body 54 having an access opening 55 with internal threads 56. The cylindrical body 54 is integrally formed with an overhang structure 58 having internal threads 60. Prior to the engagement of the threads 60 with those of the opening 20, the liner 26 must be oriented so that, upon full engagement of the overhang structure 58 and the opening 20, the second aperture 30 will be in alignment with the second opening 22. Again, if it is desired that a single opening be incorporated into the container 10, the liner 26 may be provided with a tab (not shown) for securing the liner 26 during filling.

To enable sealing of the container 10, an inner bung 62 is provided which engages the inner cylindrical body 54 and restricts the access opening 55. To provide for venting, the inner bung 62 may be further provided with an interiorly threaded opening 64 capable of acceptance of a threaded vent means 66 to further restrict the opening 20. The vent means 66 is opened by rotating a vent plug 68 some amount until the container 10 vents through the engagement of the threaded opening 64 and the vent plug 68.

After delivery of the container 10 to an industrial consumer, the materials contained therein may be extracted by removing the inner bung 46 (or 62) and engaging a suction pump (not shown) with the outer bung 32 (or 52). Once the contents have been consumed and the liner 26 is empty, the second aperture 30 may be released from the second opening 22 and the outer bung 32 (or 52) disengaged from the first opening 20. The liner 26 may then be removed through the first opening 20 and disposed of properly. The insertion of a new liner 26 immediately enables the container 10 for reuse.

With a removable liner 26, the necessity of cleaning the interior of the drum 12 has been eliminated. By removing the liner 26 through an opening 20 in the top wall 18, the detailed procedure of removing the top wall 18 or lid of the drum 10 is also eliminated. Additionally, the present invention also prevents a plastic drum 12 from becoming permeated with the transported liquid materials or cleaning materials. The final result is a drum 12 which experiences no down time for cleaning purposes.

While the above description constitutes the preferred embodiments of the present invention, it will be appreciated that the invention is susceptible to modification, variation and change without departing from the proper scope and fair meaning of the accompanying claims.

I claim:

1. A container for transporting and storing bulk liquid materials of the type including a rigid outer drum having a bottom wall, upright cylindrical side walls, and a top wall defining an enclosed central cavity of predetermined shape, said top wall further including a portion defining at least one port, said container comprising:

a thin walled removable liner positioned in said cavity and being of a shape substantially conforming to said predetermined shape, said liner including a cylindrical sleeve having portions defining at least one aperture in substantial alignment with said port;

a first bung including a body mounted to said top wall and including a cylindrical sleeve extending through said port, said sleeve having an exterior surface being fixedly bonded to an interior surface of said sleeve of said liner at said aperture so that said liner is permanently attached to said body and non-removable therefrom, said body being removably engaged with said top wall at said port and also having a threaded portion defining a first bung opening extending therethrough, said liner being substantially fully collapsible enabling removal through said port upon disengagement of said first bung from said top wall; and a second bung removably engaging said threaded portion defining said first bung opening.

2. A container for transporting and storing bulk liquid materials of the type including a rigid outer drum having a bottom wall, upright cylindrical side walls, and a top wall defining an enclosed central cavity of predetermined shape, said top wall further including a portion defining at least one port, said container comprising:

a thin walled removable liner positioned in said cavity and being of a shape substantially conforming to said predetermined shape, said liner including a cylindrical sleeve having portions defining at least one aperture insubstantial alignment with said port;

a first bung including a body mounted to said top wall and including a cylindrical sleeve extending through said port, said sleeve having an exterior surface being fixedly secured by heat sealing to an interior surface of said sleeve of said liner at said aperture so that said liner is permanently attached to said body and non-removable therefrom, said body being removably engaged with said top wall at said port and also having a threaded portion defining a first bung opening extending therethrough, said liner being substantially fully collapsible enabling removal through said port upon disengagement of said first bung from said top wall; and a second bung removably engaging said threaded portion defining said first bung opening.

* * * * *